US010441869B2

(12) United States Patent
Forrest, Jr.

(10) Patent No.: US 10,441,869 B2
(45) Date of Patent: Oct. 15, 2019

(54) HYDRATING MOUTHGUARD

(71) Applicant: Michael George Forrest, Jr., Xenia, OH (US)

(72) Inventor: Michael George Forrest, Jr., Xenia, OH (US)

( * ) Notice: Subject to any disclaimer, the term of this patent is extended or adjusted under 35 U.S.C. 154(b) by 42 days.

(21) Appl. No.: 15/907,825

(22) Filed: Feb. 28, 2018

(65) Prior Publication Data

US 2018/0243635 A1 Aug. 30, 2018

Related U.S. Application Data

(60) Provisional application No. 62/464,868, filed on Feb. 28, 2017.

(51) Int. Cl.
*A63B 71/08* (2006.01)

(52) U.S. Cl.
CPC ..... *A63B 71/085* (2013.01); *A63B 71/081* (2013.01); *A63B 2225/682* (2013.01)

(58) Field of Classification Search
CPC ..... A63B 71/085; A63B 2208/12; A63B 2071/088; A63B 2071/086; A63B 2210/50; A63B 2220/56; A63B 71/081; A63B 2209/00; A63B 2220/51; A63B 2225/50; A63B 2102/24; A63B 2213/00; A63B 71/08; A63B 71/10; A63B 2207/00; A63B 2209/14; A63B 23/03; A61F 5/566; A61F 5/56; A61F 2005/563; A61F 5/058; A61F 5/3707; A61C 7/08; A61C 7/125; A61C 7/20; A61C 19/063; A61C 7/282; A61C 7/303
See application file for complete search history.

(56) References Cited

U.S. PATENT DOCUMENTS 3,380,446 A * 4/1968 Martin ..... A61B 5/103 134/184
2007/0204867 A1* 9/2007 Kennedy, Jr. ..... A61C 17/0211 128/859
2008/0216843 A1* 9/2008 Jiang ..... A61F 5/566 128/848

OTHER PUBLICATIONS (N.d.). Retrieved Feb. 28, 2018, from http://hydratingmouthguard.com/.

* cited by examiner

*Primary Examiner* — Ophelia A Hawthorne

(57) ABSTRACT

A hydrating mouthguard. The mouthguard includes a base having U-shape with a front periphery and a rear periphery. A labial wall upstand from the front periphery of the base and a lingual wall upstands from the rear periphery of the base. A channel sized to receive a user's upper teeth is defined in between the labial wall and the lingual wall. The mouthguard further includes at least one receptacle having an entrance opening and an exit opening. At least one tube runs from the entrance opening and includes an opposing open end 20. A valve selectively allows a fluid to travel from the receptacle to the tube and out the open end.

9 Claims, 3 Drawing Sheets

HYDRATING MOUTHGUARD

CROSS-REFERENCE TO RELATED APPLICATION

This application claims the benefit of priority of U.S. provisional application No. 62/464,868, filed Feb. 28, 2017, the contents of which are herein incorporated by reference.

BACKGROUND OF THE INVENTION

The present invention relates to mouthguards and, more particularly, to a hydrating mouthguard.

A mouthguard is a protective device for the mouth that covers the teeth and gums to prevent and reduce injury to the teeth, arches, lips and gums. A mouthguard is most often used to prevent injury in contact sports. Current mouthguards are bulky in certain areas, making them uncomfortable. Athletes using mouthguards can be distracted by the discomfort.

Further, it is important for athletes to stay hydrated during competition. At certain times, athletes may need to drink hydrating liquids to perform at a high level but may not have time to drink the hydrating liquids due to participating in the competition.

As can be seen, there is a need for a mouthguard that is comfortable and can be used to hydrate the user.

SUMMARY OF THE INVENTION

In one aspect of the present invention, a mouthguard comprises: a base comprising a U-shape and having a front periphery and a rear periphery; a labial wall upstanding from the front periphery of the base; a lingual wall upstanding from the rear periphery of the base, wherein a channel is defined in between the labial wall and the lingual wall, at least one receptacle comprising an entrance opening and an exit opening; at least one tube comprising a proximal end and a distal end, wherein the proximal end is fluidly connected with the exit opening and the distal end defines an open end; and at least one valve selectively allowing a fluid to travel from the at least one receptacle to the at least one tube.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
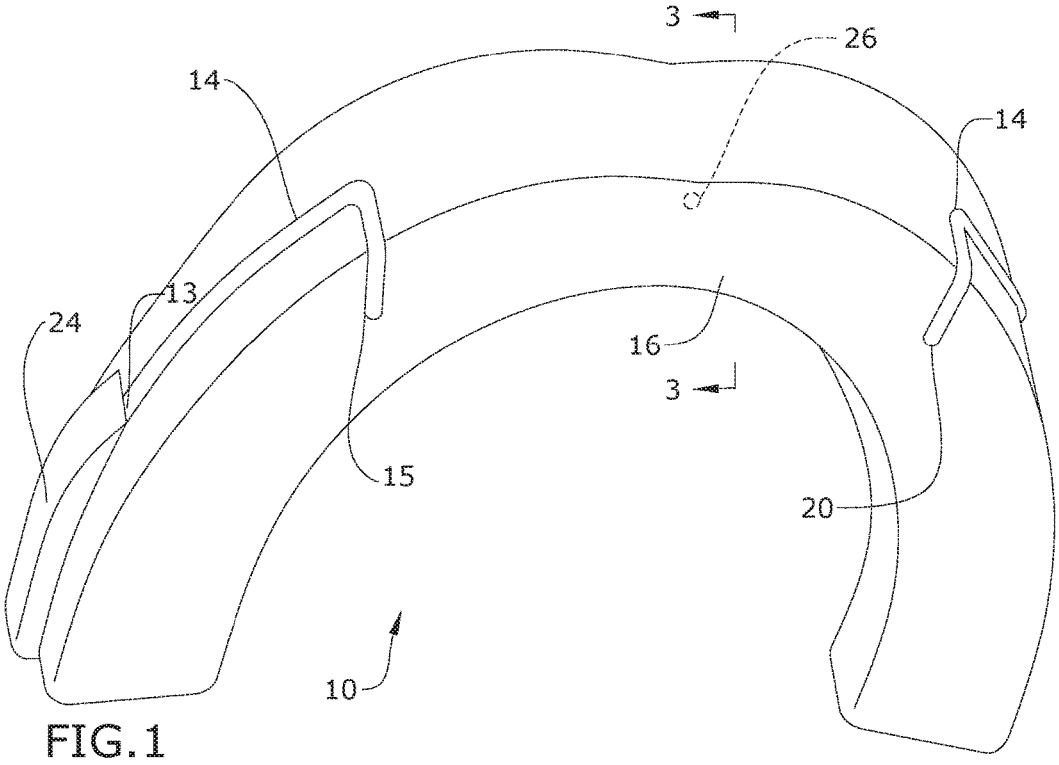
FIG. 1 is a bottom perspective view of an embodiment of the present invention.
Figure 2:
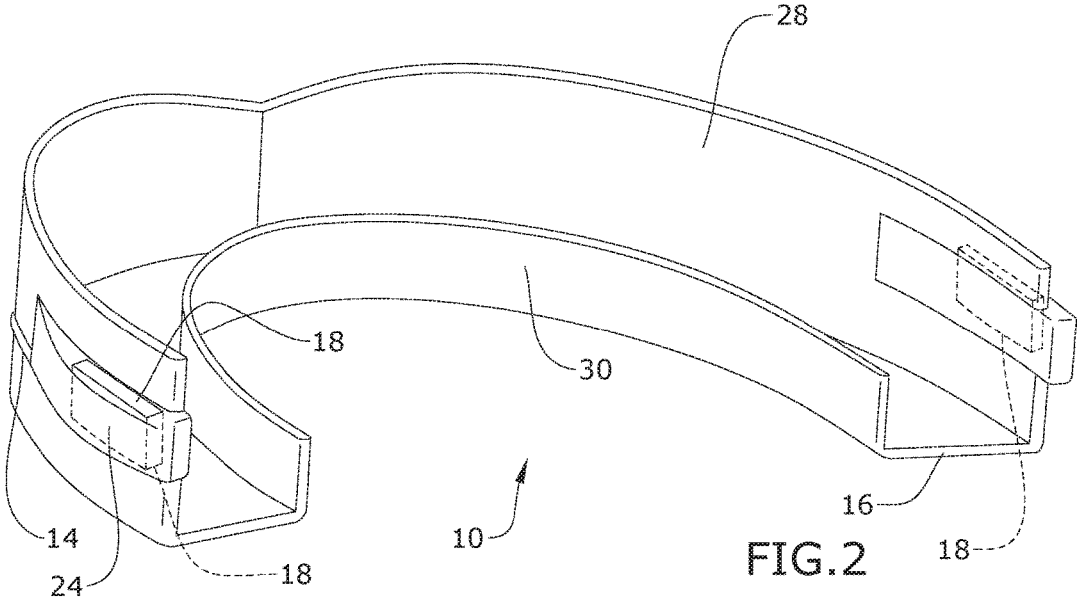
FIG. 2 is a top perspective view of an embodiment of the present invention.
Figure 3:
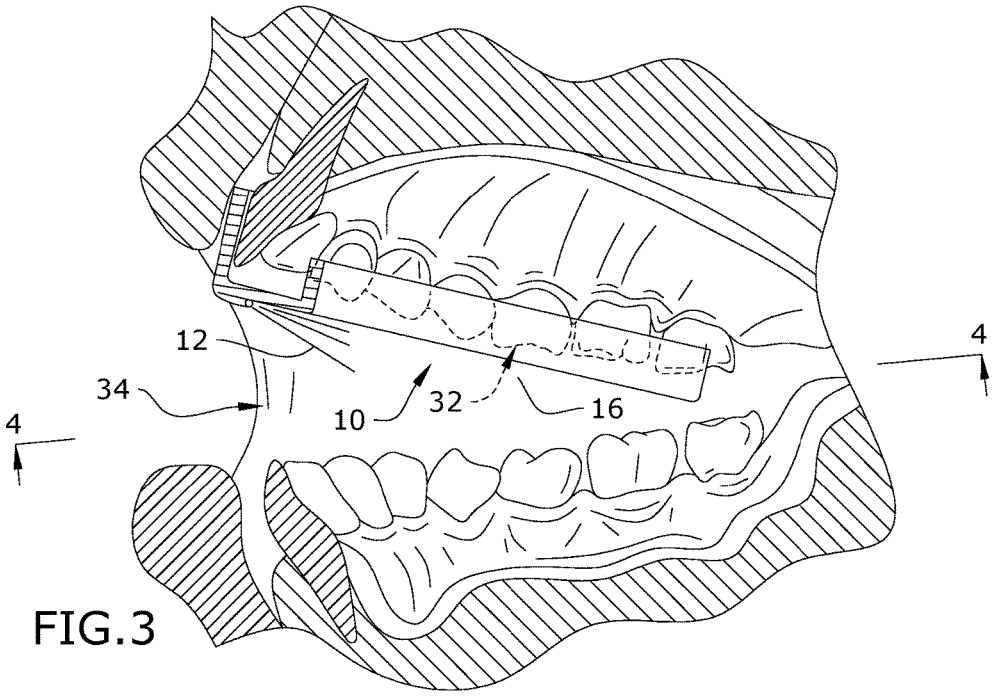
FIG. 3 is a section view of the present invention take along line 3-3 in FIG. 1, shown in use.
Figure 4:
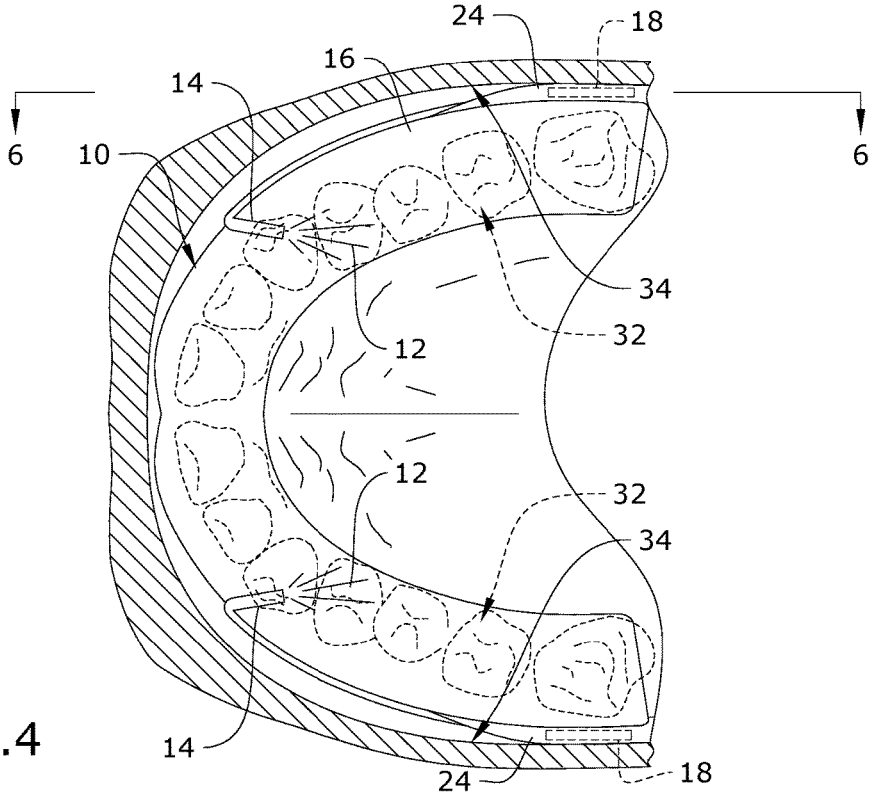
FIG. 4 is a section view of the present invention take along line 4-4 in FIG. 3, shown in use.
Figure 5:
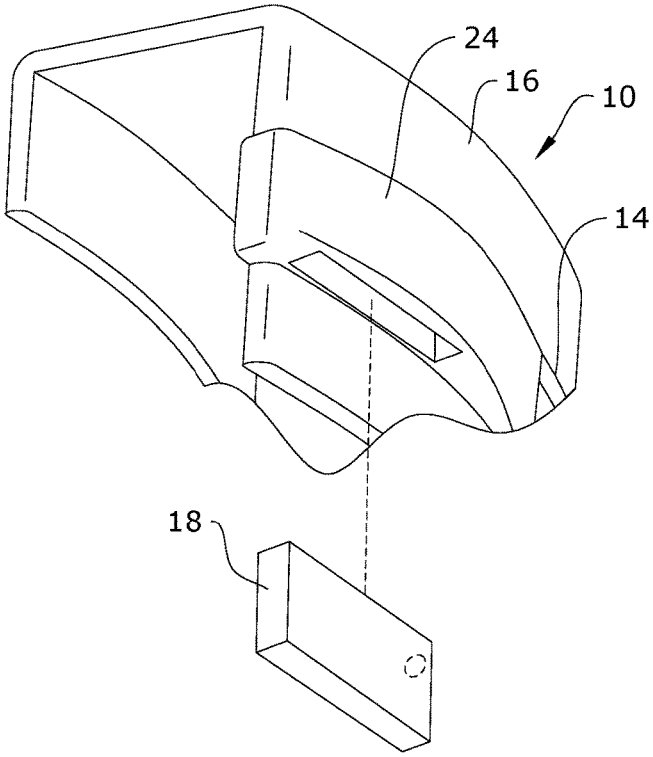
FIG. 5 is an exploded detail view of an embodiment of the present invention.
Figure 6:
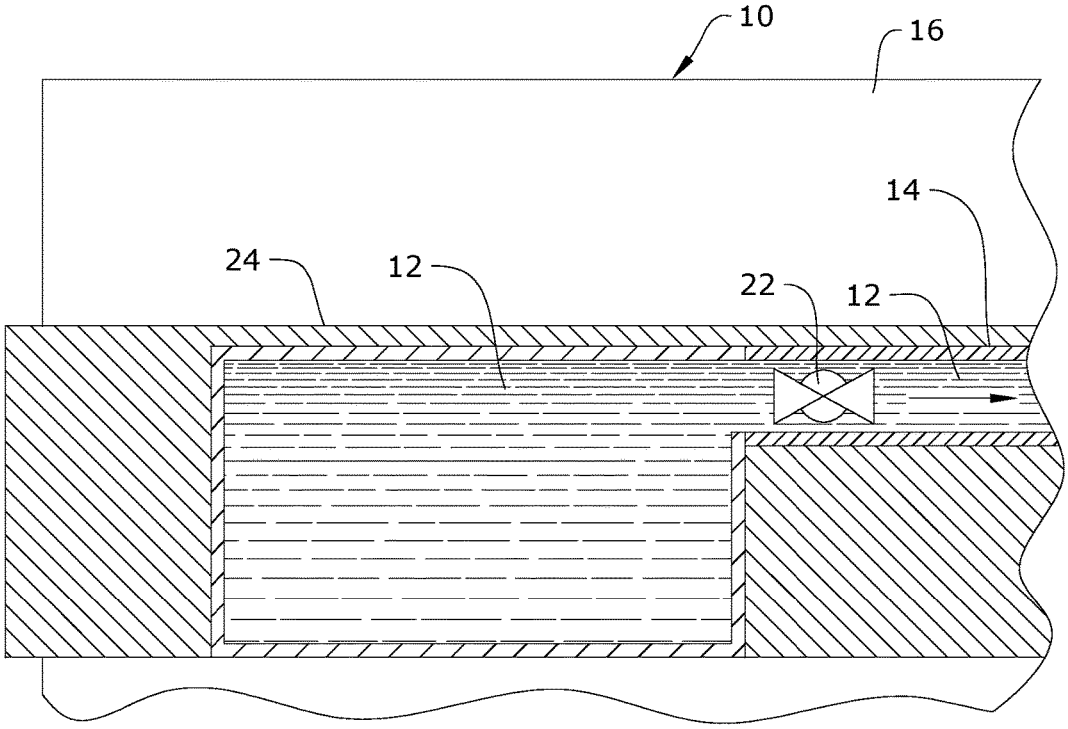
FIG. 6 is a section view of the present invention taken along line 6-6 in FIG. 4.

Referring to FIGS. 1 through 6, the present invention includes a mouthguard 10. The mouthguard 10 includes a base 16 having U-shape with a front periphery and a rear periphery. A labial wall 28 upstands from the front periphery of the base 16 and a lingual wall 30 upstands from the rear periphery of the base 16. A channel sized to receive a user's upper teeth 32 is defined in between the labial wall 28 and the lingual wall 30. The mouthguard 10 further includes at least one receptacle 24 having an entrance opening and an exit opening. At least one tube 14 runs from the entrance opening and includes an opposing open end 20. A valve 22 selectively allows a fluid 12 to travel from the receptacle 24 to the tube 14 and out the open end 20.

As mentioned above, the mouthguard 10 includes a base 16, a labial wall 28 and a lingual wall 20. The base 16 includes a U-shape having an upper surface, a lower surface, the front periphery and the rear periphery. The labial wall 28 and the lingual wall 30 also include a U-shape and may be situated substantially perpendicular relative to the base 16. The base 16, labial wall 28, and lingual wall 30 may be made of an impact absorbing material, such as, but not limited to, a thermoplastic, polyurethane, poly copolymer, POLY-SHOCK™, and the like. In certain embodiments, the thermoplastic is ethylene-vinyl acetate (EVA). The EVA thermoplastic is malleable when heated and hardens when cooled. In such embodiments, the mouthguard 10 may be heated and a user may bite down on the mouthguard 10. The mouthguard 10 is then removed from the user's mouth and is set to cool. Once cooled, the mouthguard 10 is hardened and ready for use.

In certain embodiments, the present invention may include two or more receptacles 24, two or more tubes 14, and two or more valves 22. The receptacles 24 may be disposed on the base 16, the labial wall 28, and/or the lingual wall 30. As illustrated in the Figures, a receptacle 24 may be disposed at the outer surfaces of each terminal end of the labial wall 28.

The tubes 14 may be made of a polymer, such as, but not limited to polypropylene, polyethylene and the like. A proximal end 13 of a tube 14 is fluidly connected to each of the receptacles 24. The tubes 14 may run along the outer surface of the labial wall 28 and bend up from about 90 up to about 180 degrees onto the base 16 so that the open ends 20 of distal ends 15 of the tubes 14 are facing towards the lingual wall 30 and towards the inside of the mouth 34 of the user. Alternatively, the tubes 14 may be disposed within (internal) the base 16, the labial wall 28 and/or the lingual wall 30. In such embodiments, the tubes 14 may run to one common opening 26 or more than one opening 26 formed through the base 16, the labial wall 28 and/or the lingual wall 30.

The present invention further includes a hydrating pack 18. The hydrating pack 18 includes a membrane configured to contain a liquid 12. The liquid 12 may include water or water mixed with other body replenishing elements. The hydrating pack 18 is sized to be inserted through the entrance opening and into the receptacle 24. The hydrating pack 18 may further include an opening that aligns with the exit opening of the receptacle 24. The opening may include a breakable cover that breaks when a minor pressure is applied. In alternative embodiments, a liquid may be directly injected through the entrance opening and into the receptacle 24.

The valve 22 of the present invention may be any type of valve that selectively allows fluid to run from the receptacles to the tubes 14. For example, the valve 22 may be a pressure activated valve. In such embodiments, a hydrating pack 18 may be inserted into each of the receptacles prior to partaking in athletic competition. The user may then place the mouthguard 10 on their teeth 32 and begin the athletic competition. When the user would like to hydrate themselves, the user may press against the receptacle 24, opening the valve 22 and permitting fluid to run through the tubing 14 and into their mouths. If the receptacle 24 is located on the outer surface of the labial wall 28, the user may press against the outside of their cheek to begin hydration. If the receptacle 24 is located on the inner surface of the lingual wall, the user may press against the receptacle 24 using their tongue to begin hydration.

It should be understood, of course, that the foregoing relates to exemplary embodiments of the invention and that modifications may be made without departing from the spirit and scope of the invention as set forth in the following claims.

What is claimed is:

1. A mouthguard comprising:

a base comprising a U-shape and having a front periphery and a rear periphery;

a labial wall upstanding from the front periphery of the base;

a lingual wall upstanding from the rear periphery of the base, wherein a channel is defined in between the labial wall and the lingual wall, at least one receptacle comprising an entrance opening and an exit opening;

at least one tube comprising a proximal end and a distal end, wherein the proximal end is fluidly connected with the exit opening and the distal end defines an open end; and at least one valve selectively allowing the fluid to travel from the at least one receptacle to the at least one tube, wherein the at least one tube runs from the receptacle along an outer surface of the labial wall and bends onto the base so that the open end is facing towards the lingual wall.

2. The mouthguard of claim 1, wherein the at least one receptacle is formed on at least one of the base, the labial wall, and the lingual wall.

3. The mouthguard of claim 2, wherein the at least one receptacle is formed on an outer surface of the labial wall.

4. The mouthguard of claim 3, wherein the labial wall comprises two terminal ends, wherein the at least one receptacle is formed adjacent to one of the two terminal ends.

5. The mouthguard of claim 1, wherein the at least one receptacle comprises a pair of receptacles, the at least one tube comprises a pair of tubes and the at least one valve comprises a pair of valves.

6. The mouthguard of claim 5, wherein the labial wall comprises two terminal ends, wherein the pair of receptacles are formed adjacent to the two terminal ends.

7. The mouthguard of claim 1, wherein the valve is a pressure valve.

8. The mouthguard of claim 1, further comprising a hydrating pack comprising a liquid contained within, wherein the hydrating pack is removeably disposed within the at least one receptacle.

9. A mouthguard comprising:

a base comprising a U-shape and having a front periphery and a rear periphery;

a labial wall upstanding from the front periphery of the base;

a lingual wall upstanding from the rear periphery of the base, wherein a channel is defined in between the labial wall and the lingual wall, at least one receptacle comprising an entrance opening and an exit opening;

at least one tube comprising a proximal end and a distal end, wherein the proximal end is fluidly connected with the exit opening and the distal end defines an open end;

at least one valve selectively allowing a fluid to travel from the at least one receptacle to the at least one tube; and a hydrating pack comprising the fluid contained within, wherein the hydrating pack is removeably disposed within the at least one receptacle.

* * * * *